United States Patent [19]

Piro

[11] 3,975,925

[45] Aug. 24, 1976

[54] APPARATUS FOR POSITIONING NEEDLE SELECTING CYLINDERS IN A CIRCULAR KNITTING MACHINE

[75] Inventor: Mario Piro, Genoa-Pegli, Italy

[73] Assignee: Nuova San Giorgio S.p.A., Genoa, Italy

[22] Filed: Aug. 9, 1974

[21] Appl. No.: 496,103

[30] Foreign Application Priority Data

Aug. 30, 1973 Italy ..... 28364/73

[52] U.S. Cl. ..... 66/50 B

[51] Int. Cl.[2] ..... D04B 15/74; D04B 9/00

[58] Field of Search ..... 66/50 B, 25, 154 R

[56] References Cited

UNITED STATES PATENTS

| | | | |
|---|---|---|---|
| 3,587,253 | 6/1971 | Guell | 66/50 B |
| 3,748,871 | 7/1973 | Ludwig et al. | 66/154 R |
| 3,766,753 | 10/1973 | Schnurrer | 66/154 R |
| 3,783,640 | 1/1974 | Bourgeois | 66/50 B |
| 3,846,996 | 11/1974 | Comas | 66/50 B |

*Primary Examiner*—Mervin Stein
*Assistant Examiner*—Andrew M. Falik

[57] ABSTRACT

An automatic positioning device for the control cams of the needle selecting cylinders on a circular knitting machine. According to the invention, the device comprises a portion fixed to the machine frame and a portion movable and rotating with the needle cylinder. The movable portion of the device comprises a cam support movable between extreme positions and cooperating with a retaining means operable by the fixed portion of the device to release, lock the cam and maintain it at predetermined positions between said extreme positions. On the other hand, the fixed portion of the device comprises a release member for said retaining means and cam positioning members, the cam release and positioning members being operated through linkages by a mechanical programming device.

In known prior art devices such as U.S. Pat. No. 3,766,753, a control cam is disclosed which has several profiles. The cam is positioned in a vertical direction in order to bring a desired profile into alignment with a cam follower.

7 Claims, 14 Drawing Figures

FIG. 1

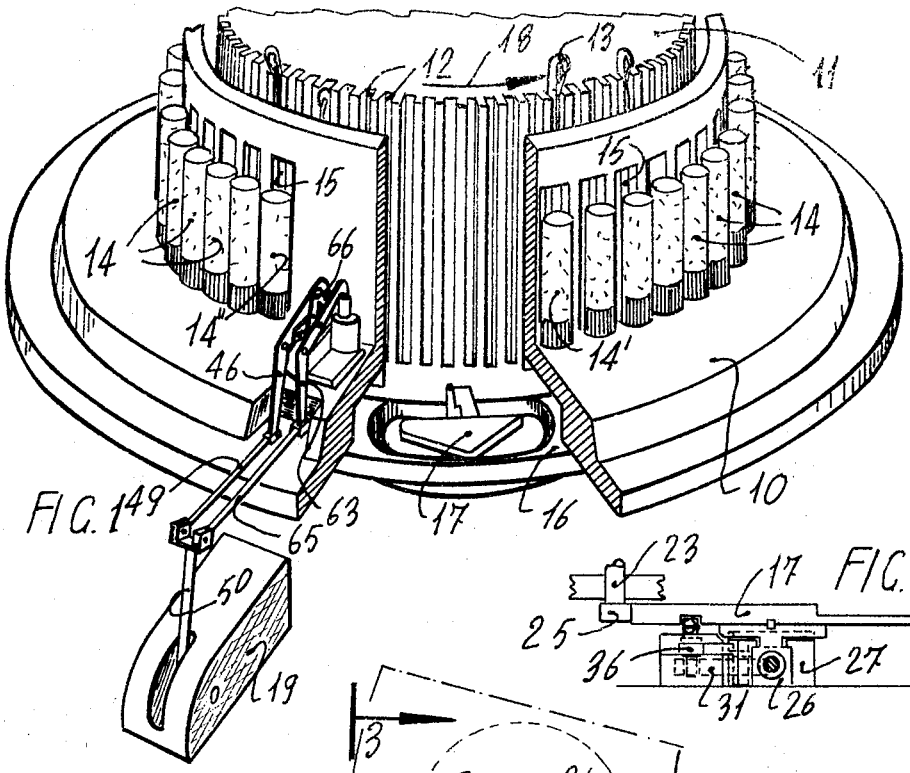
FIG. 1
FIG. 3
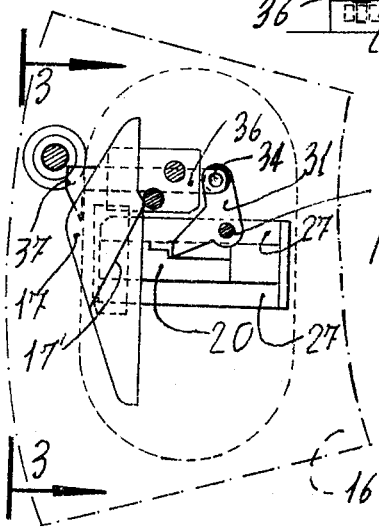
FIG. 2
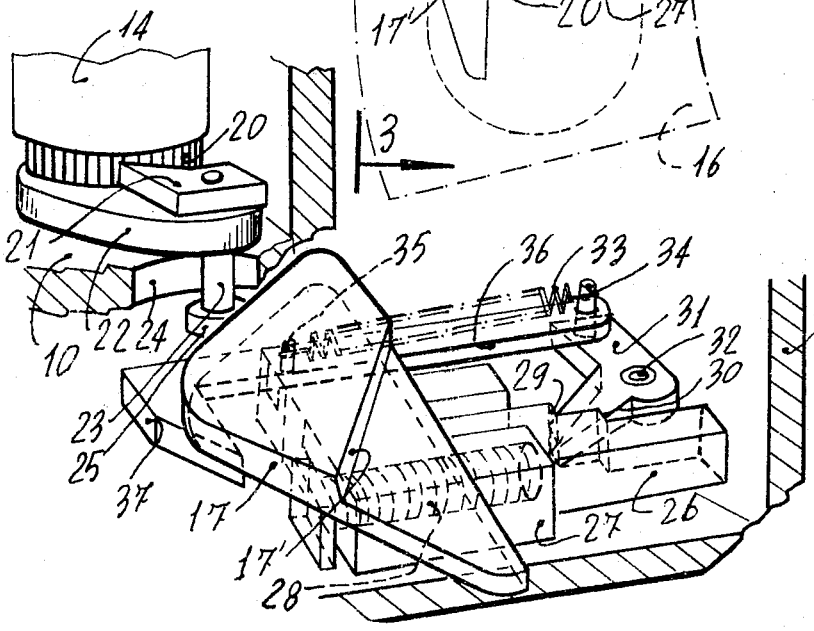
FIG. 4

APPARATUS FOR POSITIONING NEEDLE SELECTING CYLINDERS IN A CIRCULAR KNITTING MACHINE

BACKGROUND OF THE INVENTION

This invention is concerned with improvements in or relating to circular knitting machines, and more particularly the invention relates to an automatic device for positioning the control cams in needle selecting cylinders.

The present invention allows the use of a single profile cam rather than a several profile cam as shown in U.S. Pat. No. 3,766,753. In addition, the cam according to the present invention is not positioned in a vertical direction, but rather in a horizontal direction, so that the springs associated with cam positioning do not have to accommodate the weight of the cam itself, and thus eliminating the possibility that a lack of precision in the vertical positioning of the cam might adversely affect proper positioning of the follower.

As well known, a circular knitting machine substantially comprises a fixed frame carrying a needle cylinder cooperating upon rotation with a plurality of small drawing or needle selecting cylinders carried by said frame parallel and about the periphery of said needle cylinder for selecting through suitable pins or pegs the needles for the knitting machine.

These needle selecting cylinders can be maintained stationary or rotated in a predetermined direction to select the various knitting needle according to the work program and the desired pattern on the knitted fabric being formed.

The rotation through one or more steps of each needle selecting cylinder, wherein a step is meant for the spacing between two adjoining rows of pins in each of said needle selecting cylinders, is provided by a cam controlled device carried by the needle cylinder. Therefore, the control cam should be maintained stationary, radially forward or backward moved depending on the greater or smaller rotation to be imparted to each of the needle selecting cylinders at each rotation of said needle cylinder.

SUMMARY OF THE INVENTION

This invention particularly relates to a device for positioning said control cam, the device being operable by a single chain programmer and being of simple construction and reliable in operation, also enabling to maintain the cam positioned for an indefinite number of revolutions of the needle cylinder depending on the commands provided by said programmer without having to reposition the cam at every revolution of said needle cylinder.

Generally, according to the invention, a circular knitting machine comprising a needle cylinder rotatably carried by a fixed structure of the machine, and a plurality of needle selecting cylinders carried by said structure at predetermined positions around the periphery of said needle cylinder, said needle selecting cylinders being controlled by a cam for not rotating or rotating to a greater or lower extent, and provided with a cam positioning device comprising a portion attached to said structure and a portion rotating with the needle cylinder; said rotating portion including a cam for support movable between end positions and cooperating with a retaining means operable to release and lock said cam maintaining it at predetermined positions, said stationary portion of the device including a release member for said retaining means and positioning members for positioning the cam at said predetermined positions, said cam releasing and positioning members being operable through control linkages by a common single programming device.

The invention will now be more fully described with reference to a preferred embodiment as shown in the accompanying drawings, in which:

FIG. 1 shows a conventional circular knitting machine embodying the invention;

FIG. 2 is a plan view showing the movable portion of the cam positioning device according to the invention;

FIG. 3 is a view taken along line 3—3 of FIG. 2;

FIG. 4 is a perspective view of the device of FIG. 2;

Figure 6:
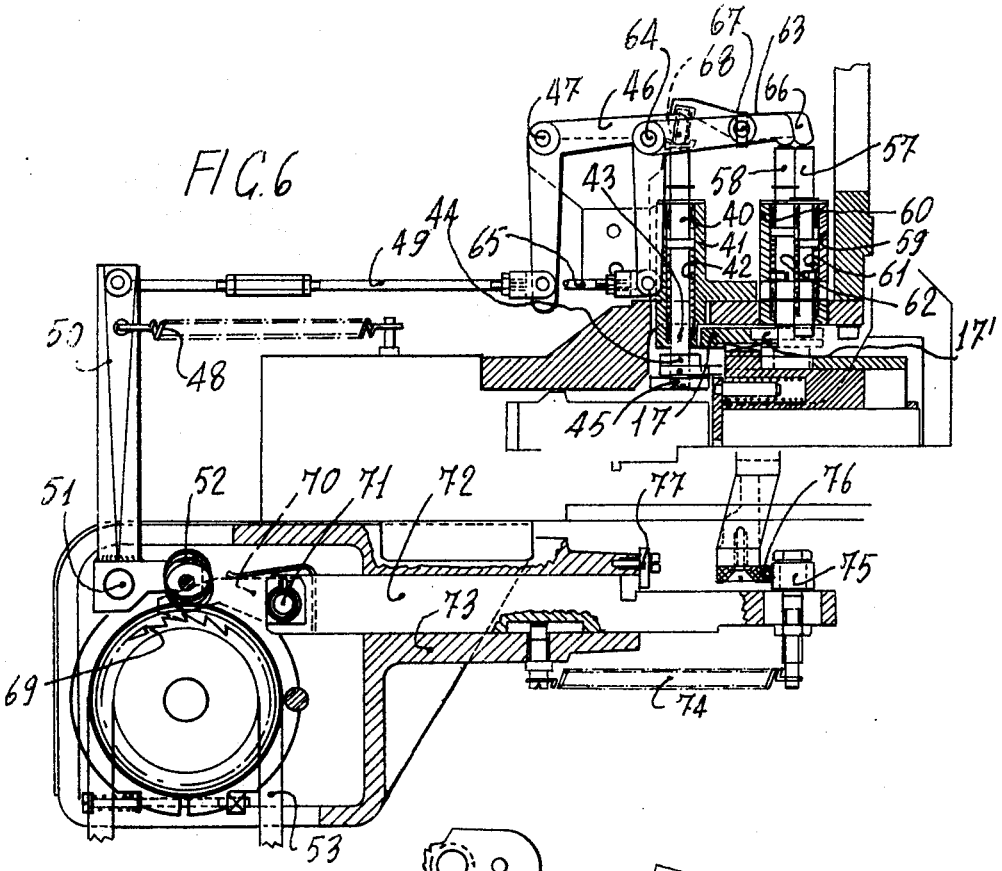
FIG. 6 is a sectional view according through a vertical plane through the line 6—6 of FIG. 5.

Referring to FIG. 1, a conventional circular knitting machine is shown therein as comprising a stationary circular structure or frame 10, internally of which a needle cylinder 11 rotates and in a per se known manner is provided with vertical grooves or guides 12, wherein corresponding knitting needles 13 are reciprocally slidable, only some of these needles 13 being shown in FIG. 1.

The various knitting needles are reciprocated by cams in their respective guides 12 as the needle cylinder 11 rotates and in known manner are selected by suitable selecting cylinders 14 rotatably carried in front of openings 15 in the stationary machine frame 10 along the major portion of the periphery of said cylinder 11.

At the bottom this needle cylinder 11 is fast with a large gear wheel 16 rotatably driven by a suitable drive device, not shown. Said gear 16 has a control cam 17, which, as the needle cylinder 11 rotates, will cause no rotation as well as a greater or less rotation of the needle selecting or drawing cylinders 14, depending on its radial position. Therefore, said control cam 17 is radially movably carried, and positionable and maintained at predetermined positions by a suitable device to be described hereinafter.

Still referring to FIG. 1, it will be seen that, since the direction of rotation for the needle cylinder 11 is given by the arrow 18, between the selecting cylinder 14' (or the first cylinder) and the selecting cylinder 14'' (or the last cylinder) there is an empty space, at which the stationary portion of the cam positioning device according to the invention is located, while the movable portion of the device is rotatably carried with the needle cylinder.

Through suitable linkages, said cam positioning device 17 is operated by a per se known chain programmer, schematically shown at 19 in FIG. 1.

As above mentioned, each of the needle selecting cylinders are rotatably driven about an axis parallel to the axis of rotation of the needle cylinder 11 and to this end, as schematically shown in FIG. 4, each of the needle selecting cylinders 14 are rotatably carried by the stationary machine frame 10 and made fast with a gear wheel 20 meshing with a ratchet gear 21 pivoted to a plate 22 rocking about the axis of the cylinder and under the action of a spring (not shown) urging it to engage with the teeth of the gear wheel 20. The plate 22 has a pin 23 downward projecting through an arcuate slit 24 on the plane of frame 10, at its lower end this pin 23 carrying a roller 25, on which the profile of said control cam 17 will be effective as the needle cylinder 11 rotates. As apparent, depending on the radial position of cam 17, this cam will not apply any thrust, or a more or less thrust on the roller 25, thus causing no rotation or a rotation of cylinder 14 through one or more teeth of gear 20. Thus, the knitting needles can be selected for each revolution of the needle cylinder in accordance with the program set on the programmer 19 or the pattern to be made.

Referring now to FIGS. 2–4, the movable portion will be described of the cam positioning device 17, that is the portion rotatably carried by the needle cylinder 11.

As shown in the drawings, the cam 17 is made fast with a sliding support, such as a rod 26, radially moving in side guides 27 attached to the needle cylinder 11 or other portion fast therewith. The sliding rod 26 is under the action of a spring 28 constantly urging it rearwardly or inwardly to move the cam 17 to a completely retracted end position.

On one of its sides, said rod 26 has two projecting stop surfaces or steps 29, 30 formed thereon, which are longitudinally spaced apart from each other and there is provided a retaining means or blocking member engageable therewith, substantially comprising a pawl 31 pivoted at 32 and biased by a return spring 33 which is secured by one end thereof to a spoke or pin 34 of said pawl 31 and by its other end is secured to a fixed pin 35, as schematically shown in FIG. 4, to constantly urge said blocking member 31 to adhere against said rod 26. Therefore, depending on the pawl 31 being engaged or not with one of said steps or projecting surfaces 29, 30, the cam 17 will be constantly maintained at one of three preselected positions for controlling the needle selecting cylinders 14, as better explained in the following.

The disengagement of pawl 31 to release the rod 26 carrying the cam 17 can be automatically effected, depending on the controls from the programmer 19 of FIG. 1, by acting on a rod 36 mounted underneath the cam 17 and parallel to the movable rod 26 of the latter. This rod 36 is pivoted at one end thereof to the pin 34 carried by said pawl 31, while at its other or lower end, this rod 36 is laterally bent and has a front thrust surface 37 formed thereon, against which a release member for the stationary portion of the device according to the invention is operable, within the space between the last selecting cylinder 14'' and the first selecting cylinder 14', as the needle cylinder 11 rotates.

At the top, the cam 17 also has a thrust surface 17' formed thereon, this surface forming an angle with the radial cam movement direction, and against which are operable corresponding positioning members, which are part of the stationary portion of the device to be described hereinafter, in order to forwardly urge said cam against said return spring 28. Since the release rod 36 can be urged or not by said release member, depending on the position given to the latter by the controls of the programming device 19, it will be appreciated that the cam 17 can maintain a proper position for one or more revolution of the needle cylinder 11 without having to continuously release and reposition it.

Figure 5:
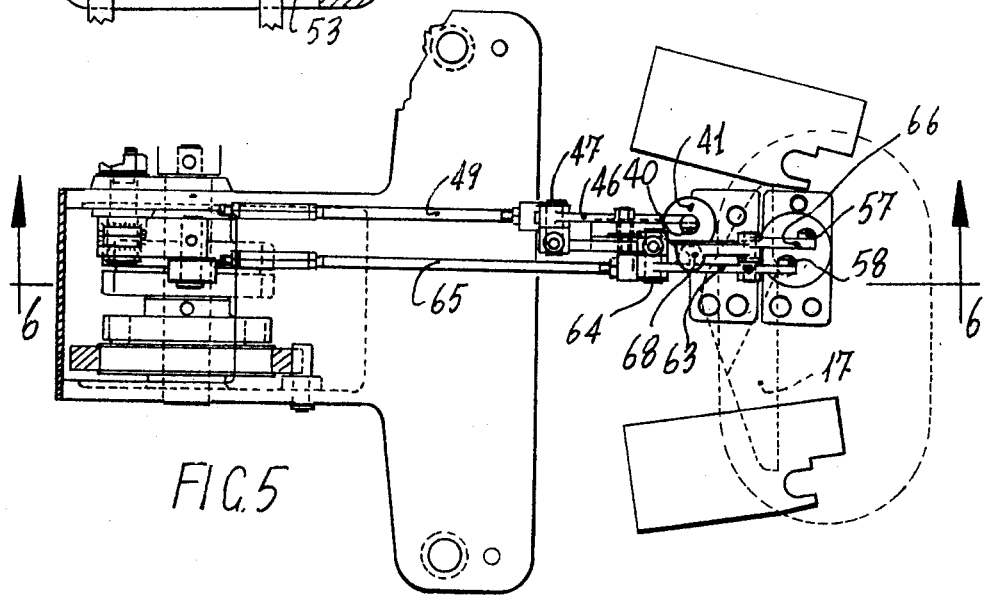
FIG. 5 is a plan view showing the stationary portion of the cam positioning device.

Referring now to FIGS. 5 and 6 of the appended drawings, the description will be set forth for the stationary portion of the device comprising the members for controlling the release and positioning of the cam 17.

From said figures, it will be seen that the member for releasing said cam 17 substantially includes a sliding member comprising a pin 40, which is vertically movable and rotatable about its horizontal axis in a fixed guide 41, this member being controlled by a return spring 42 which is effective to upwardly urge it.

As its lower end said pin 40 has three thrust surfaces 43, 44 and 45 formed thereon, the surfaces having different diameters from one another and can be brought in front of the thrust surface 37 of the cam disengaging rod 36 to release the cam.

The pin 40 can be downward urged through a bell-crank lever 46 pivoted at 47 to the machine frame and controlled by a return spring 48. This lever 46 is also connected to one end of a tie-rod 49, the other end of which is pivoted to an arm of a bell-crank lever 50 pivoted at 51 and carrying a roller 52, this roller 52 following and being suitable to read the profile of the links of a chain, designated as a whole at 53 in FIG. 5 and forming said programming device 19.

Figures 7, 8A, 8B, 8C, 9A, 9B, 9C:
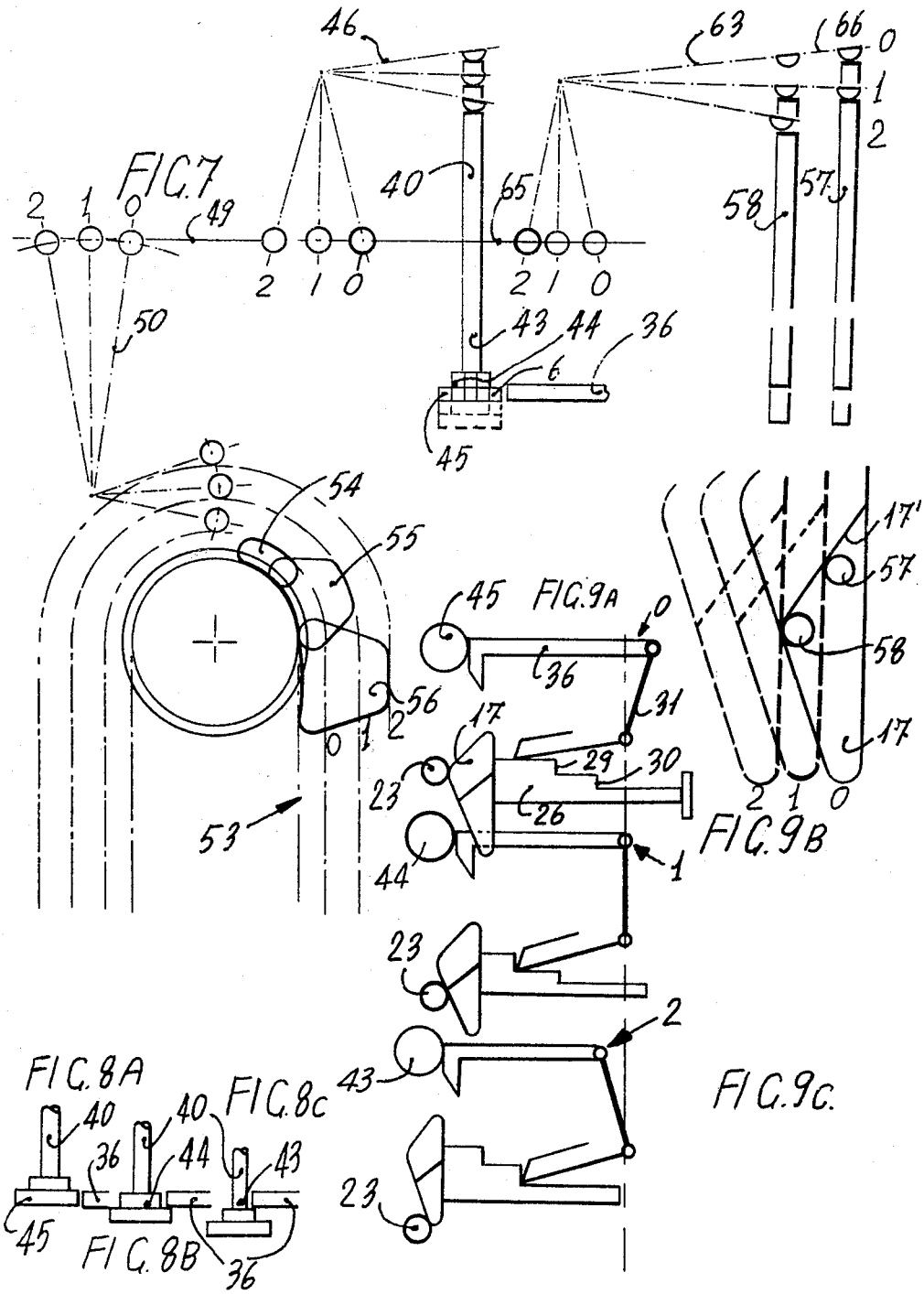
FIG. 7 is a simplified overall diagram for explaining the operation of the positioning device according to the invention.
FIGS. 8A, 8B, 8C, 9A, 9B and 9C are diagrams integrating that shown in FIG. 7.
Figure 10:
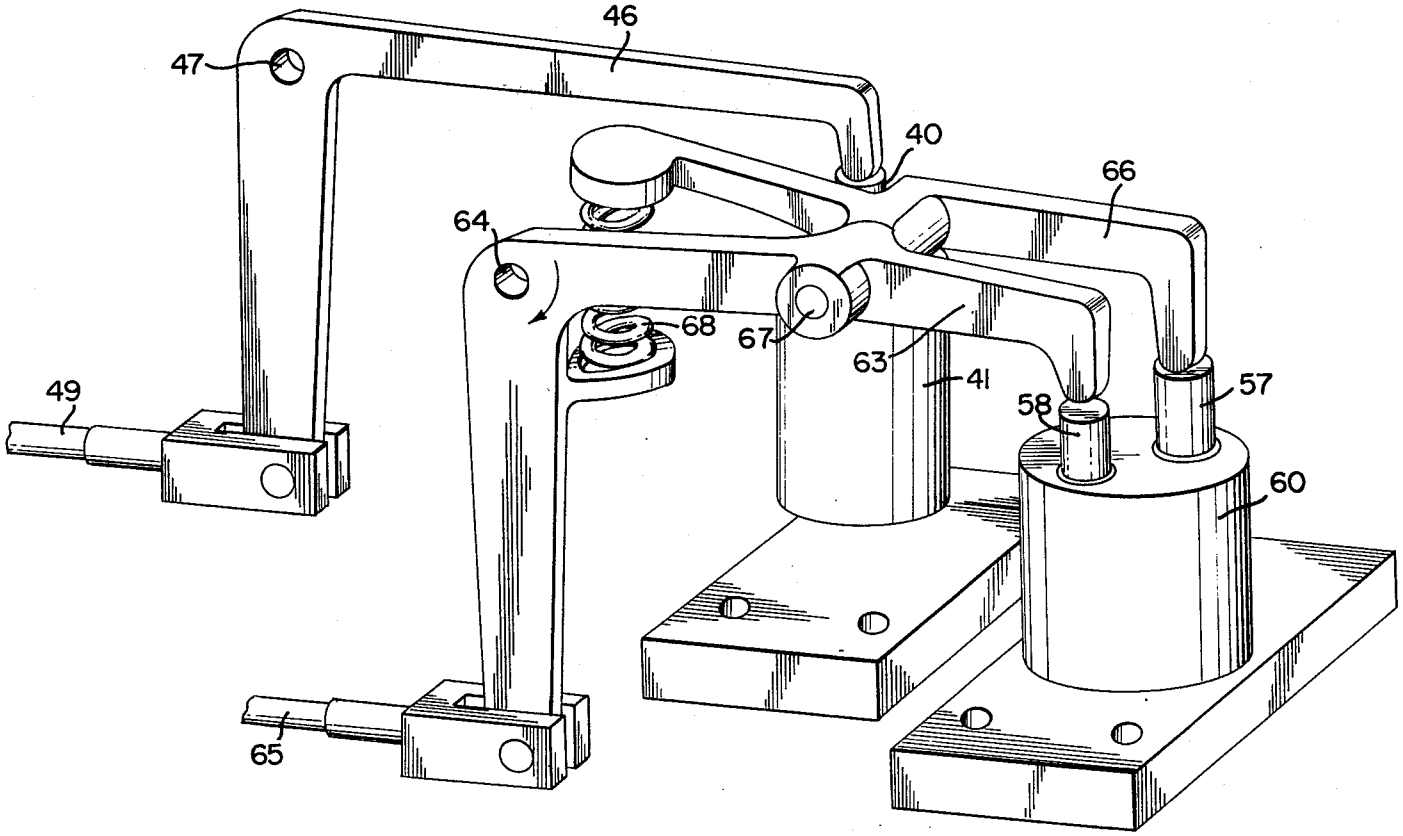
FIG. 10 is an isometric view of three bell crank levers suitable for controlling the position of a cam according to the invention, and shown in an "0" position.

This chain substantially comprises a plurality of links of a different height, as schematically shown for some links in FIG. 7, the arrangement and sequence of which will depend on the machine processing program to control, in accordance with the different height thereof; a rotation to a larger or less extent of the levers 50 and 46 and accordingly a lowering to a larger or less extent of the pin 40, so that the thrust surfaces 43, 44 and 45 of the latter are brought in front of said cam releasing rod 36. More particularly, as schematically shown in FIG. 7, said chain 53 substantially comprises three basic links of a different height, of which a link 54 is of the least height, a link 55 of intermediate height and a link 56 of the greatest height. Therefore, depending on whether the roller 52 is on one of said links 54, 55 or 56, the pin 40 will provide for positioning its surface 43, 44 or 45, respectively, in front of said rod 36.

Quite similarly, the positioning members for the cam 17 comprise two pins 57 and 58 (FIG. 6) which are angularly and radially spaced apart from each other so as to be differently effective on the thrust surface 17' of cam 17, as above mentioned. Also in this case, the pins 57 and 58 can axially slide and rotate about the axis thereof in corresponding bearings 59, 60 on the stationary machine frame. Corresponding return springs 61, 62 are effective to upward urge said pins.

As in the preceding case, the axial movement of pin 58 is provided by a bell-crank lever 63 pivoted at 64 and connected through a second tie-rod 65 to said bell-crank lever 50 reading the profile of the programming chain 53. Otherwise, the pin 57 is urged by a third lever 66 pivoted at 67 directly to the arm of said lever 63 and is also connected to the latter through a resilient connecting member 68 comprising, in the example being considered, a helical spring interposed between the rear arm of lever 66 and the front arm of said lever 63. The resilient connection 68 between levers 63 and 66 affords a first common movement therefor, followed by a relative angular movement, as better understood in the following in connection with the description of the machine operation.

The control chain 53 of the programmer 19 is stepped at each rotation of the needle cylinder 11 and to this end the gear or drum, on which this chain 53 is wound up, is connected to a serrated gear wheel 69 engaging with a pawl 70 pivoted at 71 to one end of a sliding rod 72. This rod 72 is guided in a stationary bearing 73 of the machine and controlled by a return spring 74. At its other end, said rod 72 carries a roller 75 engaging with the profile of a cam 76 carried underneath by the needle cylinder 11 to cause the chain 53 to advance through one step at each revolution of said needle cylinder. A stop 77 is for limiting the movement of rod 72.

The operation of the machine will now be described, particularly referring to FIGS. 7, 8A, 8B, 8C, 9A, 9B and 9C of the appended drawings. To this end, it should be noted that in order to aid in the disclosure, the several positions of the moving parts of the device corresponding to the links 54, 55 and 56 of different height of the control chain 53, have been denoted with the references 0 (zero), 1 and 2, thereby meaning that at position 0 no rotation will occur for the needle selecting cylinders at each revolution of the needle cylinder 11, at position 1 the needle selecting cylinder will rotate through a predetermined angle, such as one step between the rows of the pins of said needle selecting cylinder, and at position 2 the rotation of said cylinder will be larger than the preceding, for example a double or two-step rotation.

Suppose that the lever 50 has its roller 52 on a link 54, also referred to as "zero height" link, of the programming chain. Under this condition, as apparent by comparing the corresponding positions of the other members, still denoted by "0" in the drawings, the arm of lever 46 and accordingly the pin 40 are completely raised, with the thrust surface 45 of said pin which is in front of the contact surface 37 of the release rod 36, as also clearly shown in FIGS. 8A and 9A, respectively, of the appended drawings. Under this condition, the rod 36 is fully backward urged with the pawl 31 completely disengaged from the abutments or steps 29 and 30 of the cam carrying rod 26, so that under the action of the return spring 28 the cam 17 is fully backward or inward urged to the position still denoted at 0 in FIGS. 7 and 9A.

Under this condition, during the movement of cam 17 rotably driven by the needle cylinder, the cam will move with its more projecting portion or tip of its profile substantially tangentially of the pin 23 for the ratchet gear rotating the needle selecting cylinders 14, as schematically shown in FIG. 4, without causing any rotation of said cylinders.

Should the link or some subsequent links of the chain 53 be still of zero height, the whole system will remain stationary at the positions shown in FIGS. 8A and 9A and, as a result, the needle selecting cylinders 14 will remain stationary at each corresponding revolution of the needle cylinder 11.

On continued stepping of the programming chain 53, when the lever 50 senses or reads a link 55 of a different height, such as one height, the several parts of the device will move to the positions correspondingly denoted by 1, so that the arm of lever 46 and pin 40 will lower, bringing the intermediate thrust surface 44 in front of the release rod 36 (FIG. 8B) which will be backward urged, positioning the pawl 31 to the position shown in FIG. 9B. Correspondingly, the two arms of levers 63 and 66 will move from the position denoted by 0 to the position denoted by 1, still in alignment relationship to each other. This is because at 0 position only the lever 66 contacts the corresponding positioning pin 57, while lever 63 is raised. Therefore, since the stiffness of spring 68 interconnecting the levers 63 and 66 is larger than that of the return spring 61 for the pin 57, the two levers 63 and 66 will maintain unaltered the relative position thereof, with the result that only the lever 66 downward urges the pin 57, while the lever 63 contacts the pin 58.

On passing from the raised position, shown by full lines in FIG. 7, to the lowered position as shown by dashed lines, the pin 57 will be positioned for interfering with the thrust surface 17' of cam 17 so that, on continued rotation of the needle cylinder 11 and when the cam 17 passes in front of said pin 57, the latter will forward urge it by a predetermined length, as shown by the position 1 in FIGS. 7 and 9B.

On continued rotation of the needle cylinder, the cam 17 will encounter the several pins 23 controlling the rotation of the selecting cylinders 14 at an intermediate location of its front sloping surface (FIG. 9B), so that said pins are caused to advance by a predetermined length or distance and, as a result, the rotation by one step will occur for each of the cylinders 14. If the link or some subsequent links of the chain are still of 1 height, then the assembly will remain stationary at the positions shown in FIGS. 8B and 9B.

Otherwise, when the lever 50 senses or reads a link 56 of two height in said chain 53, the parts will move to the positions indicated with 2 in FIGS. 8C and 9C, respectively.

More particularly, since the pin 57 and hence the lever 66 are locked at the bottom position thereof, and on continued rotation or lowering of lever 63, the latter will move to the position indicated by 2 in FIG. 7, this movement being allowed by the yielding of the resilient connection of the spring 68 interposed between the levers 63 and 66. Therefore, the pin 58 will lower and move from the position shown by full lines to the position shown by dashed lines in FIG. 7. Since the pin 58 is radially angularly forward displaced in the direction of rotation of the needle cylinder, that is to the radially outermost position, and correspondingly the release pin 40, which had been further lowered, as shown in FIG. 8C, to bring its surface of minor diameter 43 in front of the release rod 36, the pin 58 will urge the cam 17 to its outermost position with the parts being arranged as shown in FIG. 9C, where the cam 17 is retained by the pawl 31 engaging with the surface or step 30 of the rod 26 carrying said cam.

At this position of cam 17 in FIG. 9C, the front profile of the cam will encounter the control pin 23 for the needle selecting cylinders at a forward position, or with the lowermost portion of its profile, so that the pins 23 will be forward urged by a larger distance, with a larger rotation of the selecting cylinders 14 corresponding thereto. Similarly as in the preceding cases, if the next link is still of 2 height, the parts will again remain at the positions shown in FIGS. 8C and 9C of the appended drawings.

Otherwise, should the following links be of 1 or 0 height, that is of a less height, the parts will move back to the positions shown in FIGS. 8B, 9B or 8A, 9A, respectively.

From the foregoing and as shown in the appended drawings, it will thus be appreciated that a circular knitting machine has been provided with a device for controlling the rotation of the needle selecting cylinders which, as compared with devices presently used on such machines, is of a simple construction and reliable in operation, also allowing to avoid useless and harmful repositionings of the control cam 17 when a link of a height in the programming chain 53 is followed by one or more links of a same height. This will result in a less wear of the mechanical elements and less noise in the machine operation.

What is claimed is:

1. A circular knitting machine comprising a needle cylinder rotatably carried by a stationary structure or frame of the machine, and a plurality of needle selecting cylinders arranged about the periphery of said needle cylinder, said needle selecting cylinders being controlled to rotate by a cam carried by the needle cylinder for controlling the extent of rotation of each needle selecting cylinder, a cam positioning device comprising a portion connected to said frame and a portion movable with said needle cylinder; said movable portion comprising a support for the cam movable between extreme positions and cooperating with a retaining means including means cooperable with said portion connected to the frame to release and block the cam, and maintaining it at predetermined positions between said extreme positions, said stationary portion of the device including a release member acting on said retaining means to release said retaining means from the cam, and positioning members angularly spaced apart forwardly of the release member and acting against a return spring to position the cam at said predetermined positions, said release and positioning members being operated through control linkages by a common single programming device, said movable portion of the device including a cam thrust surface, inclined to a radial direction, against which said positioning members are operative.

2. A circular knitting machine as set forth in claim 1, in which said movable portion comprises a cam support having stop surfaces and a locking element including a pawl controlled by a spring means for urging it into engagement with said stop surfaces, a control rod being connected to said locking element and being controlled by said release member to disengage said locking element from the cam support.

3. A circular knitting machine as set forth in claim 2, in which said release member comprises a first longitudinally movable release pin, having thrust surfaces that can be positioned in front of the control rod for said pawl.

4. A circular knitting machine as set forth in claim 3, in which said positioning members further comprise second and third longitudinally movable pins, each of which includes a surface that can be positioned in front of said thrust surface of the control cam, and second and third pins being angularly radially spaced apart from each other.

5. A circular knitting machine as set forth in claim 4, comprising a first control lever for said release pin, second and third control levers for said second and third positioning pins, respectively; said first and second levers being both connected to a common control lever operated by the programming device, the third lever being pivoted to the second lever and further connected thereto through a resiliently yieldable connection member.

6. A circular knitting machine as set forth in claim 4, in which said cam release and positioning pins are slidably carried and each is rotatable about the longitudinal axis thereof.

7. A circular knitting machine as set forth in claim 5, in which the resilient connection provided between said second and third levers is designed to allow a first common rotation and then a relative rotation between said levers.

* * * * *